US007541926B2

(12) United States Patent
Dugan et al.

(10) Patent No.: US 7,541,926 B2
(45) Date of Patent: Jun. 2, 2009

(54) VISITOR CONTROL AND TRACKING SYSTEM

(75) Inventors: Regina Elvira Dugan, Rockville, MD (US); Thomas Emory McVeigh, Shenandoah Junction, WV (US); Jack Kotowicz, Washington, DC (US); Lawrence Carin, Durham, NC (US)

(73) Assignee: Redxdefense, LLC, Rockville, MD (US)

( * ) Notice: Subject to any disclaimer, the term of this patent is extended or adjusted under 35 U.S.C. 154(b) by 380 days.

(21) Appl. No.: 11/543,101

(22) Filed: Oct. 5, 2006

(65) Prior Publication Data

US 2007/0109134 A1 May 17, 2007

Related U.S. Application Data

(60) Provisional application No. 60/723,476, filed on Oct. 5, 2005, provisional application No. 60/846,509, filed on Sep. 22, 2006.

(51) Int. Cl.
*G08B 13/14* (2006.01)

(52) U.S. Cl. ..... 340/572.1; 340/539.13; 340/573.1; 340/825.49; 340/10.1; 455/404.2

(58) Field of Classification Search ..... 340/572.1, 340/572.8, 573.1, 539.13, 539.16, 323 R, 340/286.01, 825.49, 10.1; 455/404.2
See application file for complete search history.

(56) References Cited

U.S. PATENT DOCUMENTS

| | | | |
|---|---|---|---|
| 4,788,039 | A | 11/1988 | Glattstein |
| 5,138,889 | A | 8/1992 | Conrad |
| 5,157,261 | A | 10/1992 | Grey et al. |
| 5,296,380 | A | 3/1994 | Margalit |
| 5,476,794 | A | 12/1995 | O'Brien et al. |
| 5,480,612 | A | 1/1996 | Margalit |
| 5,483,601 | A | 1/1996 | Faulkner |
| 5,566,327 | A | 10/1996 | Sehr |
| 5,571,976 | A | 11/1996 | Drolet |
| 5,648,047 | A | 7/1997 | Kardish et al. |
| 5,741,984 | A | 4/1998 | Danylewych-May et al. |
| 5,818,047 | A | 10/1998 | Chaney et al. |
| 5,859,375 | A | 1/1999 | Danylewych-May et al. |
| 6,028,626 | A | 2/2000 | Aviv |
| 6,073,499 | A | 6/2000 | Settles |
| 6,078,928 | A | 6/2000 | Schnase et al. |

(Continued)

FOREIGN PATENT DOCUMENTS

| | | |
|---|---|---|
| JP | 9-126965 | 5/1997 |

(Continued)

*Primary Examiner*—Davetta W Goins
(74) *Attorney, Agent, or Firm*—Diederiks & Whitelaw, PLC

(57) ABSTRACT

A visitor control and tracking system for a venue having various access points and multiple destination points includes a monitoring system that tracks location and movement of visitors to the venue. Prior to entering the venue, visitors first interact with one of a plurality of screening centers which performs a security scan. A controller operatively connected to the plurality of screening centers determines a visitor associated metric for each of the plurality of destination points. Once the controller determines the visitor associated metric, information is provided to the visitors that will help guide them about the venue. The information can be provided on a display provided on each of the plurality of screening centers and/or on displays provided about the venue.

26 Claims, 5 Drawing Sheets

U.S. PATENT DOCUMENTS

| | | | | |
|---|---|---|---|---|
| 6,424,264 | B1 | 7/2002 | Giraldin et al. | |
| 6,446,514 | B1 | 9/2002 | Danylewych-May et al. | |
| 6,509,829 | B1 * | 1/2003 | Tuttle | 340/10.1 |
| 6,529,786 | B1 | 3/2003 | Sim | |
| 6,610,977 | B2 | 8/2003 | Megerle | |
| 6,613,576 | B1 | 9/2003 | Rodacy et al. | |
| 6,674,367 | B2 * | 1/2004 | Sweatte | 340/573.1 |
| 6,747,562 | B2 * | 6/2004 | Giraldin et al. | 340/573.1 |
| 6,914,668 | B2 | 7/2005 | Brestel et al. | |
| 6,937,147 | B2 | 8/2005 | Dilbeck et al. | |
| 6,952,163 | B2 | 10/2005 | Huey et al. | |
| 6,976,032 | B1 | 12/2005 | Hull et al. | |
| 7,047,829 | B2 | 5/2006 | Napoli | |
| 7,109,869 | B2 * | 9/2006 | Sweatte | 340/573.1 |
| 7,136,513 | B2 | 11/2006 | Waehner et al. | |
| 7,327,251 | B2 * | 2/2008 | Corbett, Jr. | 340/539.13 |
| 2002/0070863 | A1 | 6/2002 | Brooking | |
| 2002/0070865 | A1 | 6/2002 | Lancos et al. | |
| 2002/0082897 | A1 | 6/2002 | Menelly et al. | |
| 2003/0013459 | A1 | 1/2003 | Rankin et al. | |
| 2003/0128100 | A1 | 7/2003 | Burkhardt et al. | |
| 2003/0130035 | A1 | 7/2003 | Kanarat | |
| 2003/0142853 | A1 | 7/2003 | Waehner et al. | |
| 2003/0149526 | A1 | 8/2003 | Zhou et al. | |
| 2004/0169589 | A1 | 9/2004 | Lea et al. | |
| 2004/0230437 | A1 | 11/2004 | Havrilak, Jr. | |
| 2004/0252024 | A1 | 12/2004 | Huey et al. | |
| 2004/0265169 | A1 | 12/2004 | Haas et al. | |
| 2005/0024204 | A1 | 2/2005 | Germaine et al. | |
| 2005/0043897 | A1 | 2/2005 | Meyer | |
| 2005/0045710 | A1 | 3/2005 | Burke et al. | |
| 2005/0057354 | A1 | 3/2005 | Jenkins et al. | |
| 2005/0074147 | A1 | 4/2005 | Smith et al. | |
| 2005/0101027 | A1 | 5/2005 | Haas | |
| 2005/0108912 | A1 | 5/2005 | Bekker | |
| 2005/0137890 | A1 | 6/2005 | Bhatt et al. | |
| 2005/0251398 | A1 | 11/2005 | Zanovitch et al. | |
| 2005/0256724 | A1 | 11/2005 | Rasin et al. | |
| 2005/0264416 | A1 | 12/2005 | Maurer | |
| 2005/0270158 | A1 | 12/2005 | Corbett, Jr. | |
| 2005/0287036 | A1 | 12/2005 | Eckels et al. | |
| 2005/0288937 | A1 | 12/2005 | Verdiramo | |
| 2006/0000903 | A1 | 1/2006 | Barry et al. | |
| 2006/0015503 | A1 | 1/2006 | Simons et al. | |
| 2006/0017541 | A1 | 1/2006 | Nguyen | |

FOREIGN PATENT DOCUMENTS

| | | |
|---|---|---|
| WO | WO 01/46916 | 6/2001 |
| WO | WO 2004/104559 | 12/2004 |

* cited by examiner

VISITOR CONTROL AND TRACKING SYSTEM

CROSS-REFERENCE TO RELATED APPLICATIONS

The present invention claims the benefit of U.S. Provisional Patent Application Ser. No. 60/723,476 entitled "Kiosk/Security and Decision Support Software, Crowd Control" filed Oct. 5, 2005, and U.S. Provisional Patent Application Ser. No. 60/846,509 entitled "Visitor Control and Tracking System" filed Sep. 22, 2006.

BACKGROUND OF THE INVENTION

1. Field of the Invention

The present invention pertains to the art of visitor control and tracking systems and, more particularly, to a visitor control and tracking system for a venue that monitors and guides visitors from one of a plurality of access points towards one or more destination points.

2. Discussion of the Prior Art

As population centers continue to grow and as the number of users of public transportation increases, it is important to monitor and control the flow of people moving from one location to another, particularly during time of heightened security. Large venues having multiple access points and multiple internal destinations, such as amusement parks, fairgrounds, historical sites, community parks and the like, can benefit from crowd control and monitoring. For example, monitoring the flow of people in a rail station enables individuals to be directed toward areas of the station that are less crowded and to a desired platform without getting lost thereby increasing their chances of finding, for example, a train or rail car without the need for a prolonged wait.

Amusement parks, fairgrounds, historical sites and the like would also benefit from crowd control and monitoring devices. Visitors entering amusement parks typically head to a favorite area without knowledge or regard for how crowded that area may be. If the visitor is provided with real-time information regarding each potential destination in the park, the visitor could opt to head to less crowded areas, or toward areas where the flow of visitors is moving quickly and lines are shorter. In this manner, the visitor's overall experience at the venue is positive, which leads to an increase in the likelihood of a return visit.

In addition to frustration that large crowds can generate, large uncontrolled crowds are an attractive target for terrorists. Terrorists use large crowds as cover for carrying out various attacks on civilian populations. The crowds themselves offer an attractive target for terrorists. During prior attacks in London and Barcelona, terrorists hid among crowds trying to board trains and plant bombs which, when detonated, resulted in deaths and injury of numerous civilians. At present, security in many transportation hubs and large venues is primarily passive. That is, many transportation hubs and other large venues simply employ cameras to monitor people waiting for trains or moving about a theme park towards various attractions. Many facilities also employ security personnel, both uniformed and undercover, that mingle with the crowds and which are ready to respond as necessary to emergency situations.

Unfortunately, large crowds often make it difficult to properly monitor all situations and areas. Actually, many terrorists watch the monitors in order to determine how security personal respond to various situations. That is, the terrorists seek out established patterns in responses. Once any patterns in the responses can be determined, plans are adjusted to compensate for the probable response in order to increase the likelihood of success of any planned event. By providing security personnel with real-time monitoring of crowd flow, randomized responses to various security threats can be developed that will thwart potential terrorists. In venues that employ security screening, individuals failing the screening process can often times get lost in the crowds before security personnel can respond. Also, without proper screening, individuals can enter private areas of the park unnoticed. Furthermore, present screening systems are not fully compatible with large crowds entering a venue. Existing screening systems are typically low-through put systems which themselves create congestion at entrances to the venue. Thus, the screening system itself generates long lines and crowds which are themselves potential targets.

Based on the above, there exists a need for an effective crowd control and monitoring system. More specifically, there exists a need for a crowd control and monitoring system that establishes a high throughput screening system, provides security personnel with a means to monitor and track potential threats, and also provides members of the crowd with real-time information regarding a particular venue or location.

SUMMARY OF THE INVENTION

The present invention is directed to a visitor control and tracking system for a venue having a plurality of access points and a plurality of destination points. In accordance with the invention, a monitoring system tracks a location and movement of individuals or crowds in the venue and works in combination with a distributed network of screening units or kiosks to provide effective crowd control and monitoring. In one embodiment, the monitoring system employs RFID tags or devices which are distributed at kiosks to visitors entering the venue. A plurality of RFID readers or receivers are arranged about the venue and function to scan for the RFID devices. A central control, operatively connected to each of the RFID receivers, tracks a location and movement of each of the RFID devices to determine a visitor associated metric for each of the plurality of destination points. In another embodiment, the visitor associated metric is simply established by visual crowd monitoring.

Once the visitor associated metric is determined, information corresponding to the visitor associated metric relating to each of the plurality of destination points is provided to visitors on various display devices provided at each access point, as well as displays preferably arranged about the venue. More specifically, crowd flow rates, capacities at each of the plurality of destination points and wait times at particular attractions are determined in real time, such as through a processor of the central control. The calculated flow rates and capacities are compared to baseline quantities stored in memory to determine crowd levels at each of the plurality of destination points. The plurality of displays then provide information which can be used to guide visitors toward desired ones of the plurality of destination points. For example, visitors entering the venue can be informed that visiting areas or attractions in a particular order will result in shorter wait times.

In further accordance with the RFID embodiment of the invention, each of the plurality of RFID devices is provided with a unique address. In this manner, the various RFID receivers can provide status information to the central control regarding particular ones of the RFID devices. In this arrangement, the venue can be divided into public areas and private areas, with the central control validating that only authorized individuals enter the private areas of the venue. In the event that an unauthorized RFID device is determined to be in a private area, a security response can be initiated. In addition, individuals who fail a security screening can be monitored, tracked and, if necessary, detained by security personnel.

In accordance with this embodiment of the invention, visitors entering an amusement park are screened for security threats prior to being presented with a keepsake containing an RFID device. If, for example, the individual fails the screening process, the RFID device in the keepsake can be tracked by the RFID receivers and, if necessary, the individual stopped and questioned by security personnel. In accordance with one aspect of the invention, a plurality of video cameras are located about the venue. Individuals who fail the initial security screen are actually tracked through the RFID tags and/or visually. The video cameras can also be employed to track and locate lost children. In another example, the RFID device can be provided in a transit pass or ticket. If the individual fails a security screen, the transit pass can be tracked throughout a particular station or even an entire transportation system through both an RFID tag embedded in the transit pass and cameras located throughout the transit system.

Furthermore, through real time tracking of the flow and location of visitors in a particular venue, various patterns can be evaluated and security responses customized to address various situations. Moreover, the type of security response can be randomized so that individuals who may be monitoring a venue's security system cannot learn and analyze response patterns which can later be employed to exploit weakness in the venue's security system.

Additional objects, features and advantages of the present invention will become more readily apparent from the following detailed description of a preferred embodiment when taken in conjunction with the drawings wherein like reference numerals refer to corresponding parts in the several views.

DETAILED DESCRIPTION OF THE PREFERRED EMBODIMENT

Figure 1:
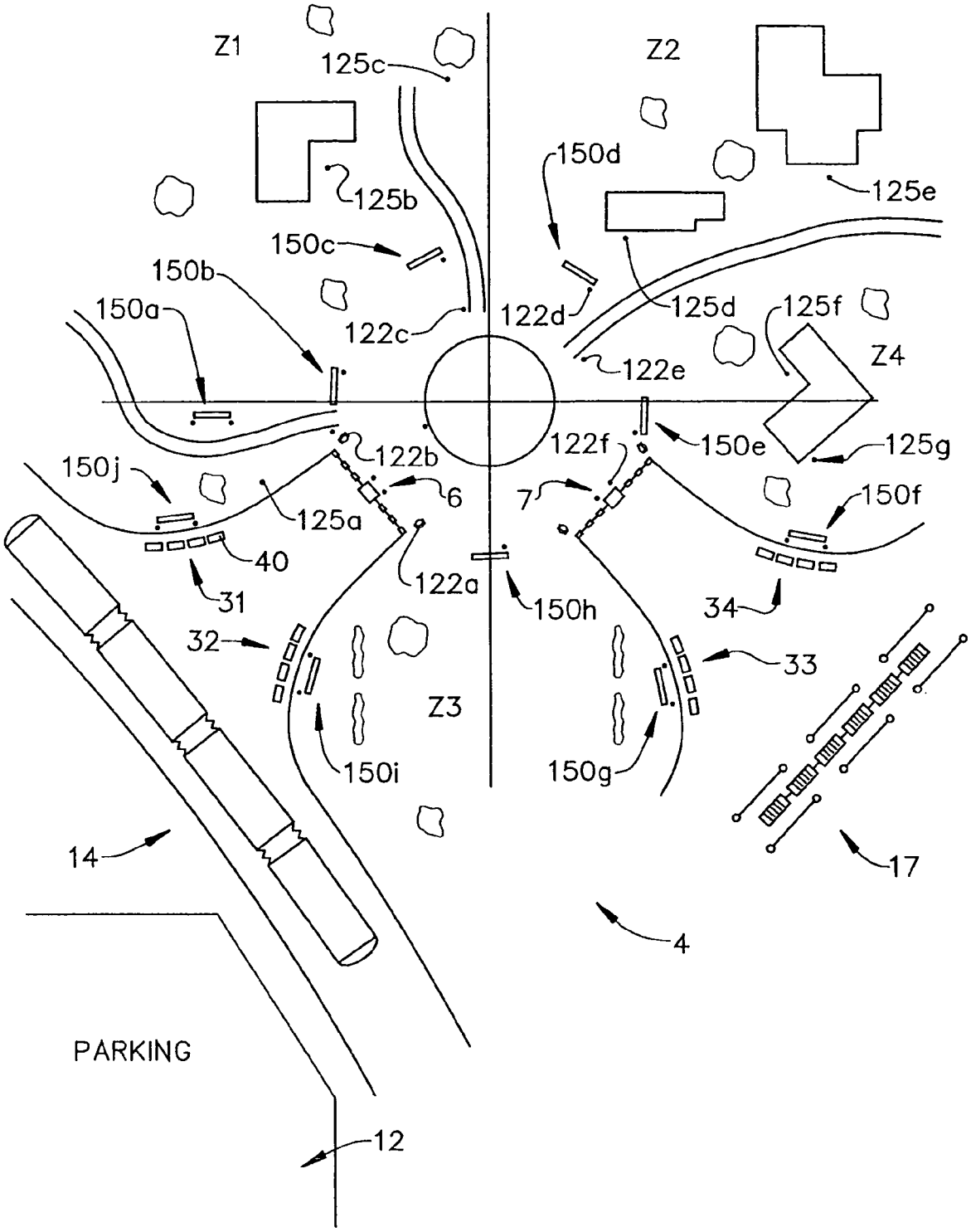
FIG. 1 is an overhead view of a venue employing a visitor control and tracking system constructed in accordance with the present invention.

The present invention is directed to a visitor control and tracking system for a venue 4, such as an amusement park venue 4 as depicted in FIG. 1. As shown, venue park 4 has multiple access points indicated generally at 6 and 7, as well as multiple destination points indicated at Z1-Z4. Of course, the number and location of access points 6, 7 and destination points Z1-Z4 can vary in accordance with the present invention. In any event, visitors seeking entrance to venue 4 can arrive through various modes of transportation, including automobiles arranged within a parking lot 12, a monorail 14 or a tram system 17. Upon arrival, visitors approach banks of security screening centers 31-34 arranged adjacent to access points 6 and 7. Each bank of screening centers 31-34 contains a plurality of individual screening centers 40 shown in detail in FIG. 2.

Figure 2:
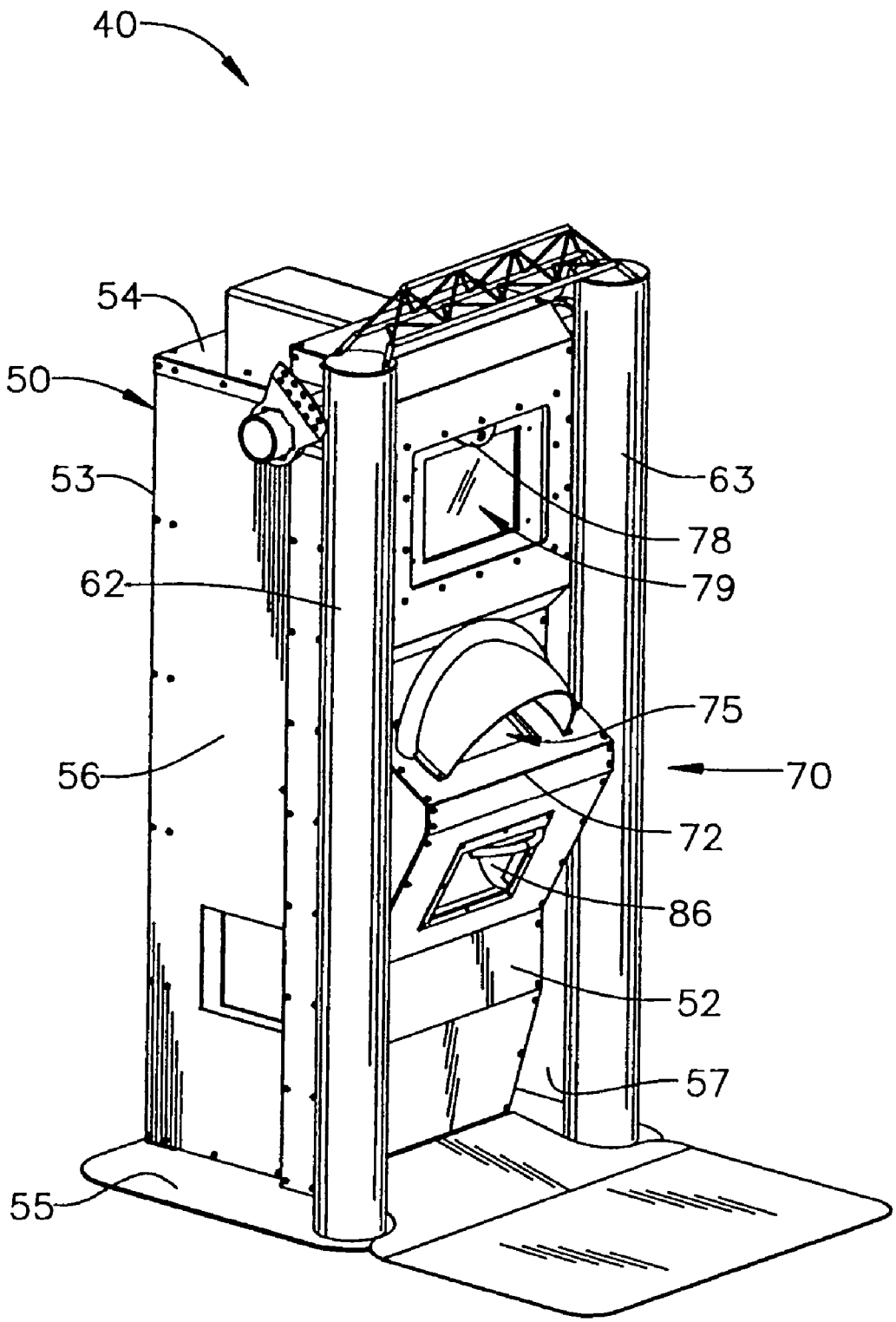
FIG. 2 is a perspective view of a security screening center employed in connection with the visitor control and tracking system of FIG. 1.

In the embodiment shown in FIG. 2, each screening center or kiosk 40 includes a main housing 50 provided with a front wall 52, a rear wall 53, a top wall 54, a bottom wall or base 55 and opposing side walls 56 and 57. Preferably, each screening center 40 is provided with various accessories that enable screening center 40 to blend in or match a particular architecture or theme at venue 4. In the embodiment shown, screening center 40 is shown with a pair of columns 62 and 63 that may mirror other columns (not shown) at access points 6 and 7. In any case, each screening center 40 can take on various configurations and/or themes, while also being readily adaptable and re-configurable to accommodate numerous, distinct venues and/or locations. Towards that end, front, rear and opposing side walls 52, 53, 56 and 57 are exposed so as to readily receive colored/printed coverings that match a particular theme.

In any event, screening center 40 includes a collection portion 70 arranged within a housing 72 that retrieves trace residue samples and certain demographic samples from a subject. As such, collection portion 70 includes a residue sample collector 75 and a demographic sample collector (not shown). In addition, security screening center 40 includes various input devices, such as an exterior camera 78 and a display 79 which, in addition to serving as an input device for screening center 40, provides the visitor with information about the various zones Z1-Z4 and attractions (not separately labeled) within venue 4. For instance, display 79 can provide information regarding a desired order in which to visit zones Z1-Z4 and/or other locations so as to encounter shorter lines and minimize wait times. In another example, display 79 can provide information guiding groups of visitors initially to different ones of zones Z1-Z4. For example, display 79 can provide information which guides the first thousand visitors to Z1, the next thousand visitors to Z2 and so on. The particular details of collection portion 70 and the input devices do not form part of the present invention and thus will not be discussed more fully herein. Instead, the details can be found in commonly assigned U.S. patent application Ser. No. 11/418,193, entitled "Security Screening and Support System", filed on May 5, 2006 and U.S. Provisional Patent Application Ser. No. 60/756,573, entitled "System and Method For Optimization For Trace Chemical Sample Collection", filed Jan. 6, 2006, both of which are incorporated herein by reference. In any case, while the visitor interacts with screening center 40, a security scan is performed to determine whether the visitor poses a potential threat to venue 4 or other visitors in a manner that will be discussed more fully below. Following the security scan, a keepsake 90 (see FIG. 3) is issued to the visitor via output portion 86.

Figure 3:
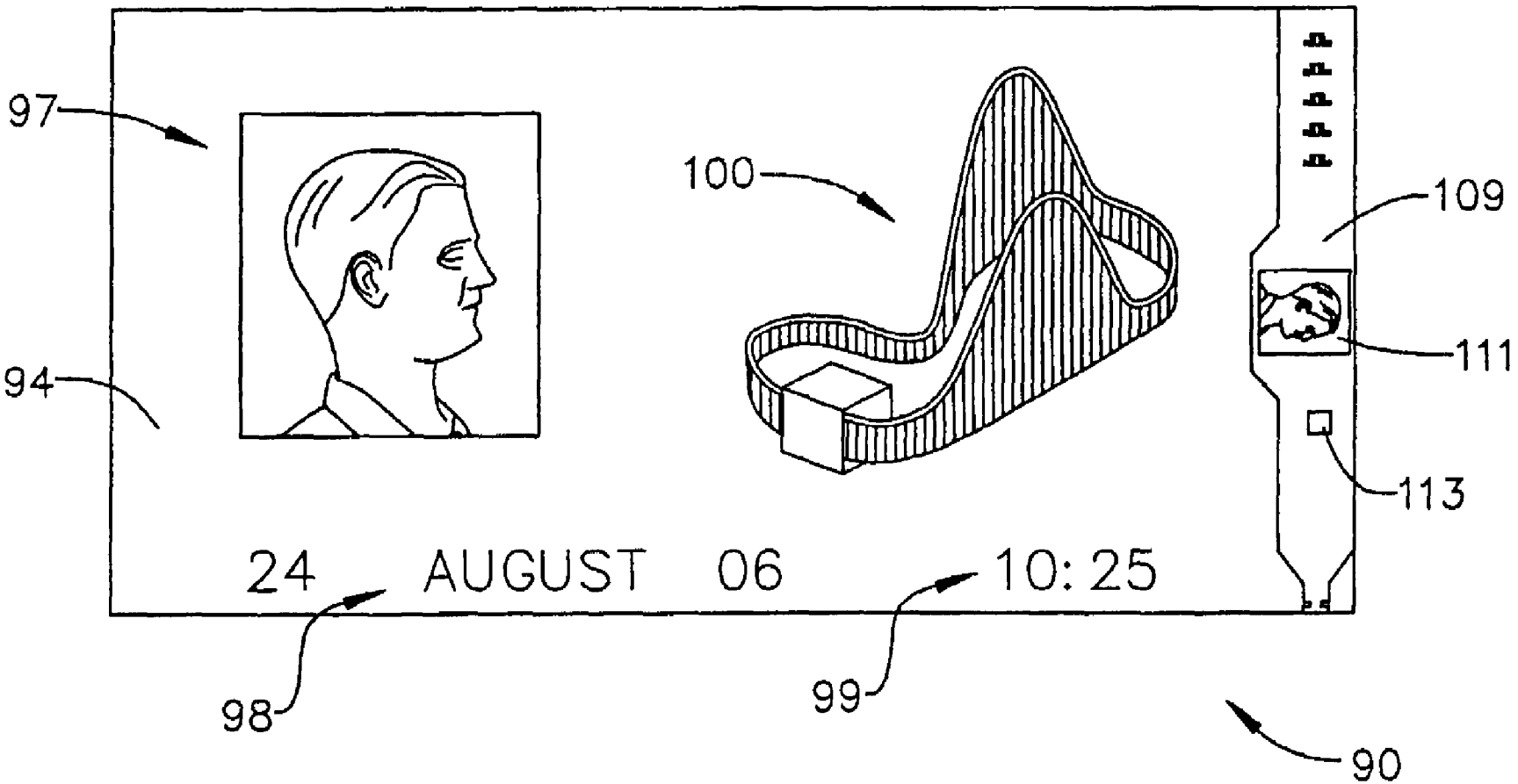
FIG. 3 is plan view of an article containing an RFID chip mounted to a bracelet issued by the security screening center of FIG. 2.

As best shown in FIG. 3, keepsake 90 includes a main body portion 94 having imprinted thereon an image 97 of the visitor captured through camera 78, a date stamp 98, a time stamp 99 and a graphic 100. Graphic 100 can take on various forms and, in addition, provide security personnel with an indication that the visitor has passed a screening process. That is, as will be discussed more fully below, the graphic can include embedded or encoded portions that indicate whether the visitor passed the security screen. In addition, keepsake 90 includes a bracelet portion 109 that is detachably connected to main body portion 94. Upon receiving keepsake 90, the visitor simply detaches bracelet 109 from main body portion 94 and secures bracelet 109 about his or her wrist during their stay in venue 4. Preferably, bracelet 109 includes an image 111 which is a reduced duplicate of image 97. In addition, bracelet 109 is provided with an RFID chip 113 having a unique address which, as will be discussed more fully below, enables the visitor control and tracking system to monitor the visitor's location and provide input regarding crowd information for each zone Z1-Z4.

Figure 4:
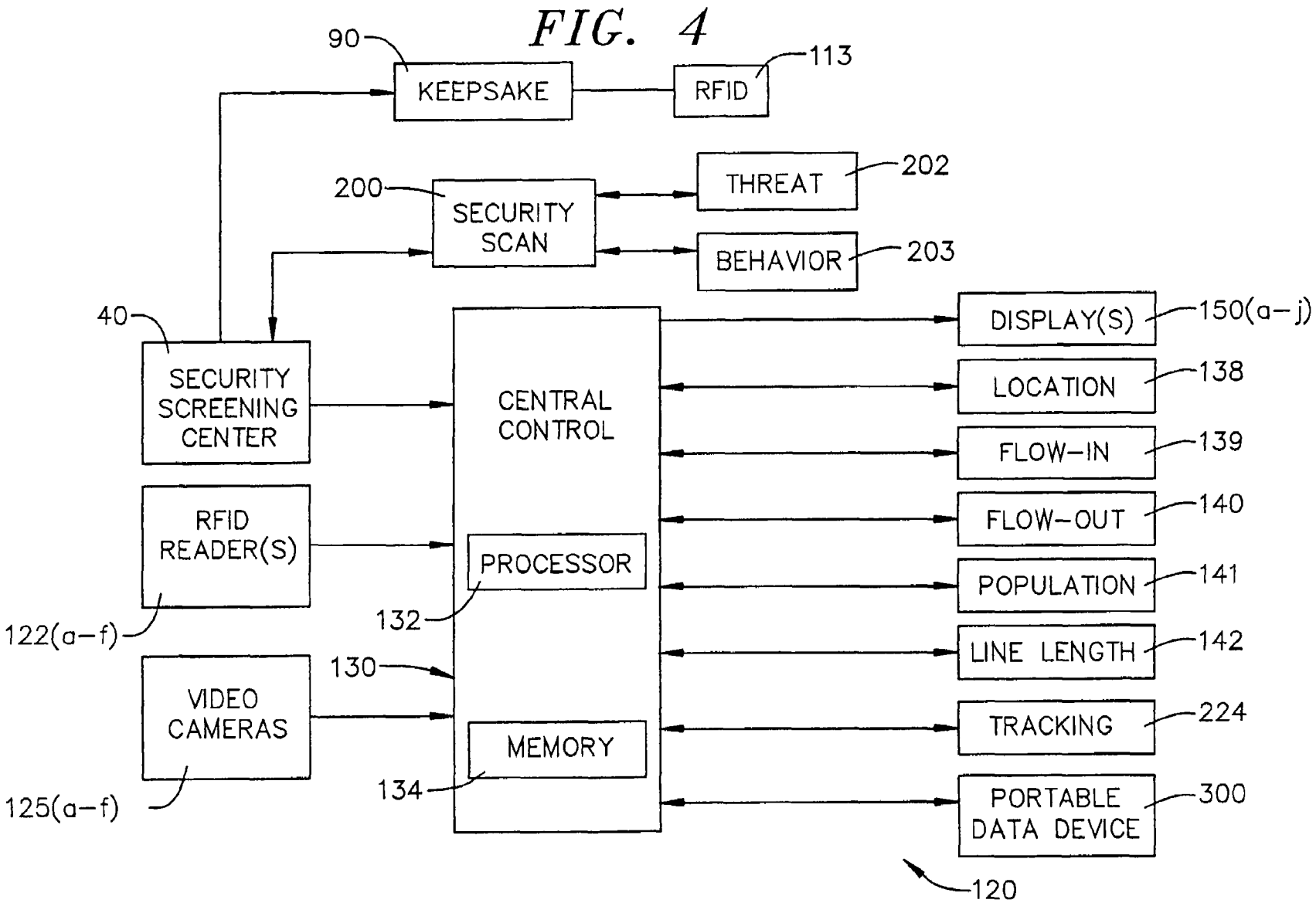
FIG. 4 is a block diagram illustrating aspects of the visitor control and tracking system of the present invention.

With reference to FIG. 4, the visitor control and tracking system includes a monitoring system (not separately labeled) that tracks the location and/or movement of visitors to venue 2. Preferably, the monitoring system includes an overall control system 120 operatively connected to a plurality of RFID readers 122*a*-122*f* that, along with security and screening centers 40, provide inputs to a central control 130. RFID readers 122*a*-122*f* are scattered about venue 4 so as to track RFID tags 113 moving about and between zones Z1-Z4. In addition, visitor control and tracking system includes a plurality of video cameras 125*a*-125*g* which, in a manner that will be discussed more fully below, cooperate with RFID readers 122*a*-122*f* to track visitors throughout venue 4. In any event, central control 130 includes a processor 132 and a memory 134. Processor 132 receives input from RFID readers 122*a*-122*f* to determine a visitor associated metric which enables visitors to be guided around venue 4 and, in particular, about and between each of zones Z1-Z4. More specifically, processor 132 includes a location determination portion 138 that identifies a location of each RFID tag 113, a flow-in portion 139 that determines a flow of visitors into each zone Z1-Z4, a flow-out portion 140 which determines a flow of visitors out of each zone Z1-Z4, a population determination portion 141 which calculates and determines the particular population in each zone Z1-Z4, and a line length determination portion 142 which determines line length at each attraction (not separately labeled) in each zone Z1-Z4.

Processor 132 compares flow-in data, flow-out data and population data with data stored in memory 134. That is, memory 134 includes both maximum in and out flow rate data for each zone Z1-Z4, as well as a maximum capacity value for each zone Z1-Z4. Thus, central control 130 determines which zones Z1-Z4 are under or over capacity and directs visitors toward zones that are under capacity in a manner that will be described more fully below.

Figure 5:
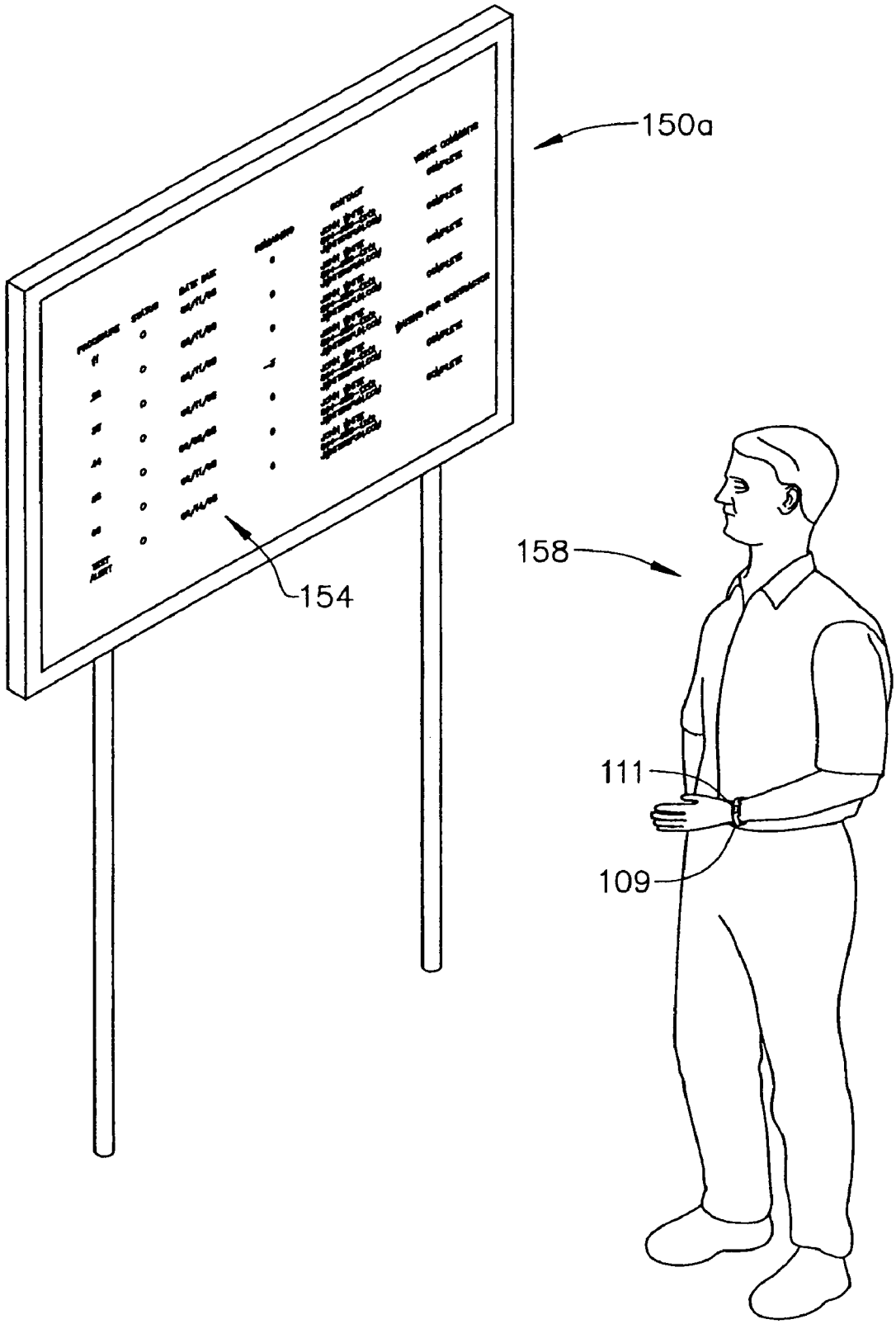
FIG. 5 illustrates a visitor viewing a display that provides information regarding various portions of the venue of FIG. 1 as determined by the visitor control and tracking system.

In addition to display 79 provided on security screening center 40, visitor tracking control system includes a plurality of displays 150*a*-150*j* (see FIG. 1) arranged within venue 4 that provide visitor metric information, indicated generally at 154 in FIG. 5, to visitors 158 moving about venue 4. In accordance with a preferred embodiment of the invention, each display 79 and 150*a*-150*j* provides a visitor with information relating to the number of visitors in each zone Z1-Z4, whether any one of zones Z1-Z4 is at or above capacity, and which attractions within each zone Z1-Z4 is operating under capacity. In this manner, the visitor can appropriately choose which zone Z1-Z4 or even particular zone attraction to visit. Thus, the visitor control and tracking system in accordance with the present invention guides visitors about venue 4 in a manner that minimizes crowding, wait times and confusion, thereby enhancing the visitor's overall experience.

In addition to guiding visitors about venue 4, the visitor control and tracking system performs a security screening of each visitor. Towards that end, as represented in FIG. 4, screening center 40 includes a security scanning portion 200 having a threat assessment portion 202 and a behavior analysis portion 203. Threat assessment portion 202 scans for a threat residue obtained through residue sample collector 75, while behavior analysis portion 203 scans for any odd behavior exhibited by the visitor. The particular operation of residue sample collector 75 does not form part of the present application and can be found in commonly assigned U.S. patent application Ser. No. 11/418,193, entitled "Security Screening and Support System", filed on May 5, 2006 and U.S. Provisional Patent Application Ser. No. 60/756,573, entitled "System and Method For Optimization For Trace Chemical Sample Collection", filed Jan. 6, 2006, again incorporated herein by reference. That is, collected data, such as from external camera 78 and sample collector 75 which, according to a preferred embodiment includes an internal camera (not shown), is evaluated and categorized against known data representing both normal behavior and abnormal behavior to produce an output which represents a degree to which the current data is similar to normal or abnormal behavior. More specifically, based on timing of the interaction, pressure applied, interplay with camera 78 and/or sample collector 75, behavior analysis portion 203 then assigns a numerical value that is considered in determining the possibility that a visitor is a potential threat. Inputs in determining whether behavior of a visitor is normal or abnormal also include time records of activity, face and hand video screens, face and hand images, and interactions with residue sample collector 75. In order to make a proper analysis, comparative normal behavior data is collected from visitors who interact with security center 40 naturally. Comparative abnormal behavior data is collected from visitors who are directed to attempt to "beat the system." The comparative normal behavior and comparative abnormal behavior result in distinct differences which indicate natural and deceptive interaction with security center 40.

In accordance with one aspect of the invention, normal and abnormal comparison data is periodically updated using "supervised learning." One form of supervised learning occurs when local processing of data received through the input sensors contains unfamiliar attributes. The unfamiliar attributes are sent to a comparison database contained within behavior analysis portion 203. Another form of update occurs when security screening center 40 sounds an alarm on a particular visitor. In this situation, sensor information is presented to security operation center personnel who determine the validity of a potential threat, perform necessary actions, and resolve the threat condition. Sensor data and threat resolution information is then stored in behavior analysis portion 203 in order to update databases contained therein. In any event, as set forth above, once the security scan is complete, security screening center 40 issues an article or keepsake 90 to the visitor. If the visitor fails the security screen, an embedded code or graphic known only to security personnel is imprinted on keepsake 90. Thus, when presenting keepsake 90 to security personnel in order to gain entry, visitors who have failed the security screen can be subjected to greater scrutiny.

Central control 130 also includes a tracking portion 224 which can track each individual visitor through the unique address in each RFID chip 113 about venue 4. By tracking real-time crowd flow and the location of each visitor, central control 130 can establish patterns of movement in venue 4. The patterns of movement are employed by security personnel to determine responses to various situations. Moreover, the patterns of movement can be employed to develop randomized responses to prevent individuals from learning and analyzing responses and exploit weaknesses in the security system. In addition, tracking portion 224, working in combination with RFID readers 122*a*-122*f* and video cameras 125*a*-125*g*, can track individuals, particularly those who fail the initial security screen. In addition, RFID readers 122*a*-122*f* and video cameras 125*a*-125*g* can be employed to determine whether visitors are moving about public portions of venue 4 or whether a visitor has moved into private portions of venue 4.

A visitor observed in private areas of venue 4 can be quickly located and escorted back into the public areas. Central control 130 is preferably linked to security personnel through a plurality of portable data devices, such as indicated generally at 300 in FIG. 4. In this manner, central control 130 can quickly and efficiently transmit information to security personnel provided with portable data device 300 regarding a location of a person of interest. In addition to providing text information, central control 130 can also transmit visual images of the person of interest through portable data device 300. Of course, tracking portion 224 can also be employed to locate individuals who may become lost within venue 4.

Based on the above, it should be readily apparent that the visitor control and tracking system of the invention provides for real-time crowd monitoring, advanced visitor guidance and enhanced venue security. In particular, it should be realized that the visitor control and tracking functions can be performed at the screening centers or kiosks only, in combination with cameras provided throughout the venue and/or with the use of the RFID chips and readers. In any case, a visitor associated metric would be established for crowd control purposes. The visitor readable displays can simply be constituted by those at the kiosks or the kiosk displays in combination with various displays arranged throughout the venue. The invention also has various security aspects. In particular, in addition to performing explosive checks at the kiosks, abnormal behavior can be monitored. In this case, each kiosk serves as security sentinel whereby the kiosk is an interactive tool to assess behavior. Additional security and tracking features exist with the use of the RFID tags. Further security is established in connection with the randomized responses.

Although shown with venue 4 illustrated as an amusement park, it should be readily understood that the present invention is readily adaptable into a wide variety of venues that have multiple entrance points and multiple destination points, such as metro systems, stadiums, parks, fairgrounds, historical sites and the like. Although described with reference to preferred embodiments of the invention, it should be readily understood that various changes and/or modifications can be made to the invention without departing from the spirit thereof. For instance, while the monitoring system is described as employing RFID readers to scan for RFID devices carried by each visitor, it should be understood other devices such as video cameras, passive or active sensors and the like can also be employed. In general, the invention is only intended to be limited by the scope of the following claims.

We claim:

1. A visitor control and tracking system for a venue having a plurality of access points and a plurality of destination points comprising:

a monitoring system for tracking location and movement of visitors to the venue, said monitoring system including a network of screening centers distributed about the venue in connection with the plurality of access points;

a controller for determining a visitor associated metric for each of the plurality of destination points based on signals received from the monitoring system; and a plurality of display devices arranged about the venue and operatively connected to the controller, said plurality of display devices presenting information to visitors regarding at least one of the plurality of destination points.

2. The visitor control and tracking system according to claim 1, wherein the visitor associated metric includes at least one of a flow-in rate to one of the plurality of destination points, a flow-out rate of the one of the plurality of destination points and a population at the one of the plurality of the destination points.

3. The visitor control and tracking system according to claim 2, wherein the central control includes a memory having stored therein at least one of a maximum flow-in rate data, maximum flow-out rate data and maximum capacity data for each of the plurality of destination points.

4. The visitor control and tracking system according to claim 3, wherein the information presented on each of the plurality of displays is based upon differences between respective ones of the at least one flow-in rate, the flow-out rate, the population, the maximum flow-in rate, the maximum flow-out rate and the maximum capacity data.

5. The visitor control and tracking system according to claim 1, wherein the monitoring system includes:

a plurality of RFID devices distributed to visitors to the venue; and a plurality of RFID receivers arranged about the venue between the plurality of access points and the plurality of destination points, said RFID receivers scanning for the plurality of RFID devices.

6. The visitor control and tracking system according to claim 5, wherein the controller tracks the plurality of RFID devices to determine whether any visitor has moved from a public area of the venue into a private area of the venue.

7. The visitor control and tracking system according to claim 1, wherein each of the plurality of screening centers is adapted to perform a security scan of each visitor entering the venue.

8. The visitor control and tracking system according to claim 7, further comprising: a keepsake dispensed from the at least one security screening center upon completion of a security scan.

9. The visitor control and tracking system according to claim 8, wherein the keepsake includes a bracelet portion incorporating an RFID device.

10. The visitor control and tracking system according to claim 7, wherein the security screening center includes a threat assessment portion and a behavior analysis portion.

11. The visitor control and tracking system according to claim 10, wherein said behavior analysis portion scans for odd behavior exhibited from a visitor.

12. The visitor control and tracking system according to claim 1, wherein the plurality of display devices are incorporated in the network of screening centers.

13. The visitor control and tracking system according to claim 1, further comprising: a plurality of video cameras arranged about the venue, said video cameras being operatively connected to the controller to enable visual tracking of visitors in the venue.

14. The visitor control and tracking system according to claim 1, further comprising: a plurality of portable data devices operatively connected to the controller, said portable data devices being adapted to receive security information from the controller.

15. A method of tracking and assisting visitors in a venue having a plurality of access points and a plurality of destination points comprising:

screening visitors entering the venue;

monitoring visitor movement about the venue towards various ones of the plurality of destination points;

determining a visitor associated metric for each of the plurality of destination points; and displaying information to the visitors regarding the visitor associated metric for each of the plurality of destination points.

16. The method of claim 15, wherein determining the visitor associated metric includes comparing a flow-in rate to one of the plurality of destination points with a maximum flow-in rate to the one of the plurality of destination points.

17. The method of claim 15, wherein determining the visitor associated metric includes comparing a flow-out rate of one of the plurality of destination points with a maximum flow-out rate from the one of the plurality of destination points.

18. The method of claim 15, wherein determining the visitor associated metric includes comparing current population data at one of the plurality of destination points with a maximum capacity data for the one of the plurality of destination points.

19. The method of claim 15, wherein determining the visitor associated metric includes determining wait times for one or more attractions located in at least one of the plurality of destination points.

20. The method according to claim 15, wherein displaying information to the visitors occurs at screening centers used in screening the visitors entering the venue.

21. The method of claim 20, wherein screening visitors includes a behavioral analysis for odd behavior of each visitor.

22. The method of claim 15, further comprising: monitoring the venue through a plurality of video cameras.

23. The method of claim 15, further comprising:

distributing RFID devices to visitors entering the venue through one of the plurality of access points; and tracking the RFID devices with a plurality of RFID readers as the visitors move about the venue towards various ones of the plurality of destination points.

24. The method of claim 23, further comprising:

providing each of the plurality of RFID devices with a unique address; and tracking visitors that fail the security scan.

25. The method of claim 23, further comprising: tracking each of the plurality of RFID devices to determine if any visitor has moved from a public area of the venue to a private area of the venue.

26. The method of claim 23, further comprising: transmitting security information regarding one of the plurality of RFID devices to portable data devices.

* * * * *